US008188823B2

(12) United States Patent
Le et al.

(10) Patent No.: US 8,188,823 B2
(45) Date of Patent: May 29, 2012

(54) DRY-TYPE TRANSFORMER WITH A POLYMER SHIELD CASE AND A METHOD OF MANUFACTURING THE SAME

(75) Inventors: Hoan D. Le, Wendell, NC (US); Steve A. Shaw, Greenville, NC (US); Stephen Clifford, Bremgarten (CH)

(73) Assignee: ABB Technology AG, Zurich (CH)

( * ) Notice: Subject to any disclaimer, the term of this patent is extended or adjusted under 35 U.S.C. 154(b) by 77 days.

(21) Appl. No.: 12/678,307

(22) PCT Filed: Sep. 19, 2008

(86) PCT No.: PCT/US2008/010908

§ 371 (c)(1),
(2), (4) Date: Mar. 16, 2010

(87) PCT Pub. No.: WO2009/042076

PCT Pub. Date: Apr. 2, 2009

(65) Prior Publication Data

US 2010/0201472 A1 Aug. 12, 2010

Related U.S. Application Data

(60) Provisional application No. 60/974,117, filed on Sep. 21, 2007.

(51) Int. Cl.
*H01F 38/30* (2006.01)
*H01F 27/02* (2006.01)

(52) U.S. Cl. ..... 336/84 R; 336/90; 336/98; 336/92; 336/83

(58) Field of Classification Search ..... 336/90, 336/96, 98, 92, 229, 84 R, 83
See application file for complete search history.

(56) References Cited

U.S. PATENT DOCUMENTS

| | | | | |
|---|---|---|---|---|
| 2,297,605 | A | 9/1942 | Camilli | |
| 2,960,756 | A | 11/1960 | Treanor | |
| 3,517,361 | A | 6/1970 | Reifel et al. | |
| 3,996,543 | A | 12/1976 | Conner et al. | |
| 4,199,743 | A | 4/1980 | Martincic | |
| 4,400,340 | A | 8/1983 | Klosiewicz | |
| 4,459,576 | A * | 7/1984 | Fox et al. | 336/84 C |
| 4,504,813 | A | 3/1985 | Strang | |

(Continued)

FOREIGN PATENT DOCUMENTS

EP 1 783 155 9/2007

(Continued)

OTHER PUBLICATIONS

Final Office Action, U.S. Appl. No. 11/518,682, Applicant Rodney Godbey, Confirmation No. 4124, mail date: Jul. 14, 2010, delivery mode: paper United States Patent and Trademark Office, Alexandria Virginia 22313-1450.

(Continued)

*Primary Examiner* — Anh Mai
(74) *Attorney, Agent, or Firm* — Paul R. Katterle

(57) ABSTRACT

The invention is directed to a transformer and a method of manufacturing the same, wherein at least a portion of a core is disposed inside a shield case formed from a polymeric resin composition containing conductive particles. An encasement comprising a dielectric resin encapsulates the shield case. An electrical conductor is electrically connected to the shield case and is accessible from the exterior of the encasement.

17 Claims, 11 Drawing Sheets

U.S. PATENT DOCUMENTS

| | | | | |
|---|---|---|---|---|
| 5,008,065 | A | 4/1991 | Okumura et al. | |
| 5,083,360 | A | 1/1992 | Valencic et al. | |
| 5,464,585 | A | 11/1995 | Fitzgibbon | |
| 5,480,940 | A | 1/1996 | Khasat et al. | |
| 5,860,550 | A | 1/1999 | Miller et al. | |
| 6,031,442 | A | 2/2000 | Nakazawa | |
| 6,204,347 | B1 | 3/2001 | Hafner et al. | |
| 6,310,533 | B2 * | 10/2001 | Coulombier | 336/90 |
| 6,331,586 | B1 | 12/2001 | Thielen et al. | |
| 6,486,279 | B2 | 11/2002 | Lynn et al. | |
| 6,689,835 | B2 | 2/2004 | Amarasekera et al. | |
| 6,753,749 | B1 | 6/2004 | Chin | |
| 7,230,808 | B2 | 6/2007 | Kirby et al. | |
| 2005/0270134 | A1 * | 12/2005 | Skinner et al. | 336/84 R |
| 2006/0069199 | A1 * | 3/2006 | Charati et al. | 524/496 |
| 2006/0125593 | A1 | 6/2006 | Piaskowski | |
| 2007/0231587 | A1 * | 10/2007 | Naito et al. | 428/457 |
| 2007/0241852 | A1 | 10/2007 | Goudreau | |
| 2007/0265379 | A1 * | 11/2007 | Chen et al. | 524/404 |
| 2008/0061915 | A1 | 3/2008 | Godbey | |
| 2008/0096022 | A1 * | 4/2008 | Naito et al. | 428/409 |

FOREIGN PATENT DOCUMENTS

| | | |
|---|---|---|
| GB | 1156369 | 6/1969 |
| WO | WO 2007/051342 | 5/2007 |
| WO | 2009042076 | 2/2009 |

OTHER PUBLICATIONS

Paul R. Katterle, Attorney, Appeal Brief with a petition for a one-month extension of time, Applicant: Rodney Godbey, Assignee: ABB Technology AG, U.S. Appl. No. 11/518,682, Confirmation No. 4124, Title: Dry-Type Transformer with Shielded Core/Coil Assembly and Method of Manufacturing the Same, Date Submitted: Jan. 14, 2011 electronic submission to the United States Patent and Trademark Office.

Before the board of patent appeals and interferences, Examiner's answer, U.S. Appl. No. 11/518,682, filed Sep. 11, 2006, Applicant: Godbey, Rodney, Confirmation No. 4124, Mail date: Apr. 7, 2011, delivery mode: paper, United States Patent and Trademark Office, Alexandria, Virginia 22313-1450.

* cited by examiner

DRY-TYPE TRANSFORMER WITH A POLYMER SHIELD CASE AND A METHOD OF MANUFACTURING THE SAME

BACKGROUND OF THE INVENTION

This invention relates to transformers and more particularly to transformers having a dry-type construction with solid insulation.

A transformer with a dry-type construction includes at least one coil mounted to a core so as to form a core/coil assembly. The core is ferromagnetic and is often comprised of a stack of metal plates or laminations composed of grain-oriented silicon steel. The core/coil assembly is encapsulated in a solid insulating material to insulate and seal the core/coil assembly from the outside environment.

The solid insulating material that is used to encapsulate the core/coil assembly of a dry-type transformer is typically a thermoset polymer, which is a polymer material that cures, through the addition of energy, to a stronger form. The energy may be in the form of heat (generally above 200 degrees Celsius), through a chemical reaction, or irradiation. A thermoset resin is usually liquid or malleable prior to curing, which permits the resin to be molded. When a thermoset resin cures, molecules in the resin cross-link, which causes the resin to harden. After curing, a thermoset resin cannot be remelted or remolded, without destroying its original characteristics. Thermoset resins include epoxies, melamines, phenolics and ureas.

When a thermoset resin cures, the resin typically shrinks. Because the resin surrounds the core/coil assembly, the shrinking thermoset resin exerts high mechanical stresses and strains on the core of the transformer. These stresses and strains distort the oriented grains of the core and increase resistance to the magnetic flux flow in the laminations. This distortion and increased resistance results in higher core loss which causes the sensitivity of the transformer to decrease and diminishes the accuracy of the transformer. In addition, when the thermoset resin shrinks around edges and protrusions, cracks may form in the thermoset resin. The cracks may grow over time and compromise the insulating properties of the thermoset resin. As a result, partial discharges may occur. A partial discharge is an electrical spark that bridges the thermoset resin between portions of the core/coil assembly. A partial discharge doesn't necessarily occur at the core/coil assembly, it can occur anywhere the electric field strength exceeds the breakdown strength of the thermoset resin. Partial discharges contribute to the deterioration of the thermoset resin, which shortens the useful life of the transformer.

One approach for protecting the core of a transformer and preventing partial discharges has been disclosed in U.S. patent application Ser. No. 11/518,682, filed on Sep. 11, 2006, entitled "DRY-TYPE TRANSFORMER WITH SHIELDED CORE/COIL ASSEMBLY AND METHOD OF MANUFACTURING THE SAME", which is assigned to the assignee of the present invention, ABB Technology AG, and which is incorporated herein by reference. In the '682 patent application, a core and coil assembly of a transformer are disposed inside a protective polymer case having an exterior surface that is at least partially covered with a conductive coating. The present invention is directed toward such a protective polymer case having an improved construction.

SUMMARY OF THE INVENTION

In accordance with the present invention, a transformer is provided that includes a shield case formed from a polymeric resin composition comprising conductive particles. At least a portion of a core comprised of ferromagnetic material is disposed inside the shield case. A primary coil and a secondary coil are disposed proximate to the core. An encasement encapsulates the shield case. The encasement comprises a dielectric resin.

Also provided in accordance with the present invention is a method of producing a transformer. In accordance with the method, a shield case is provided. The shield case is formed from a polymeric resin composition containing conductive particles. A coil and a core comprised of ferromagnetic material are also provided. The coil is disposed around the core and at least a portion of the core is placed inside at least a portion of the shield case. The shield case is encapsulated in a dielectric resin.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
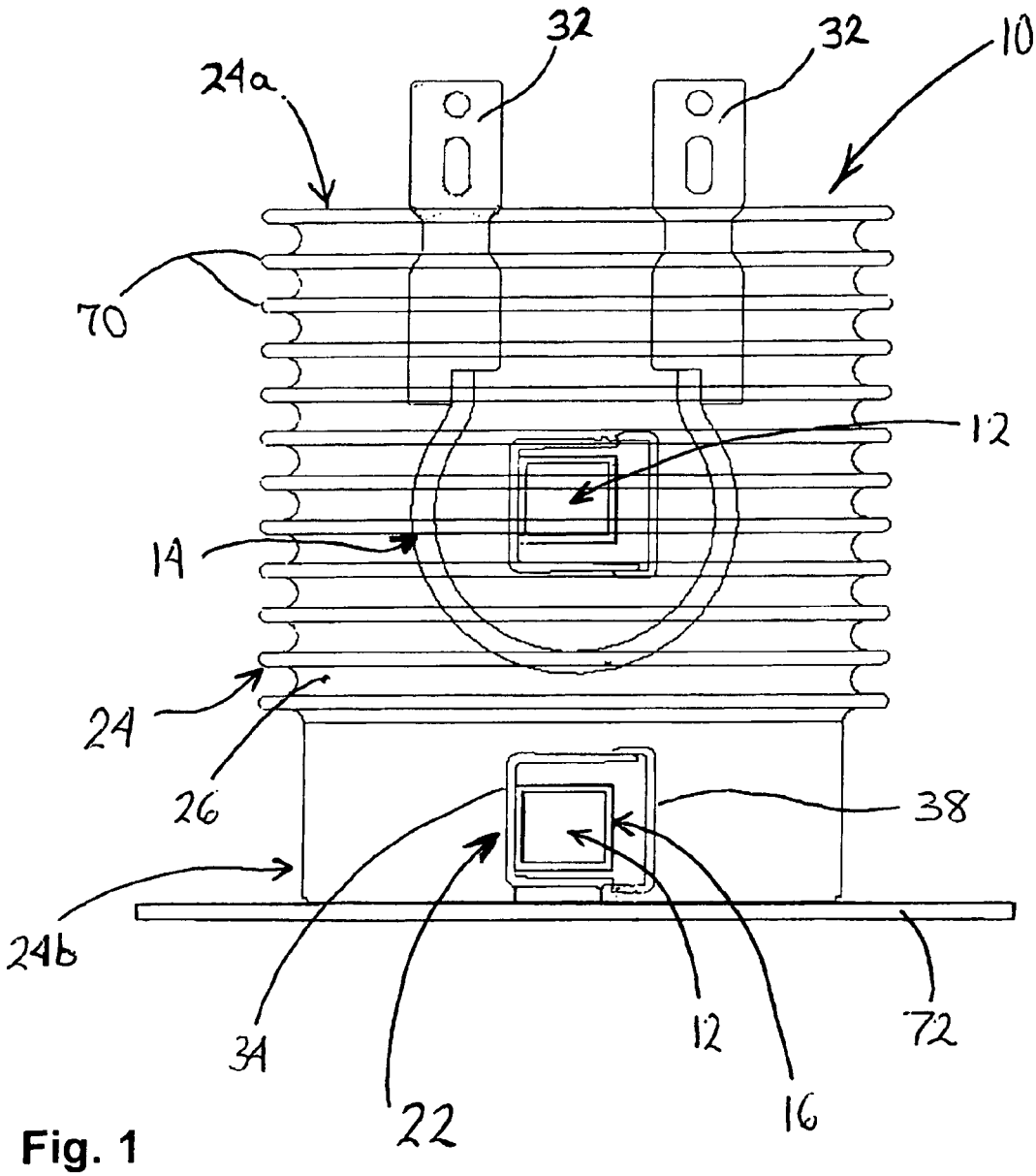
FIG. 1 is a schematic view of a transformer embodied in accordance with the present invention.
Figure 2:
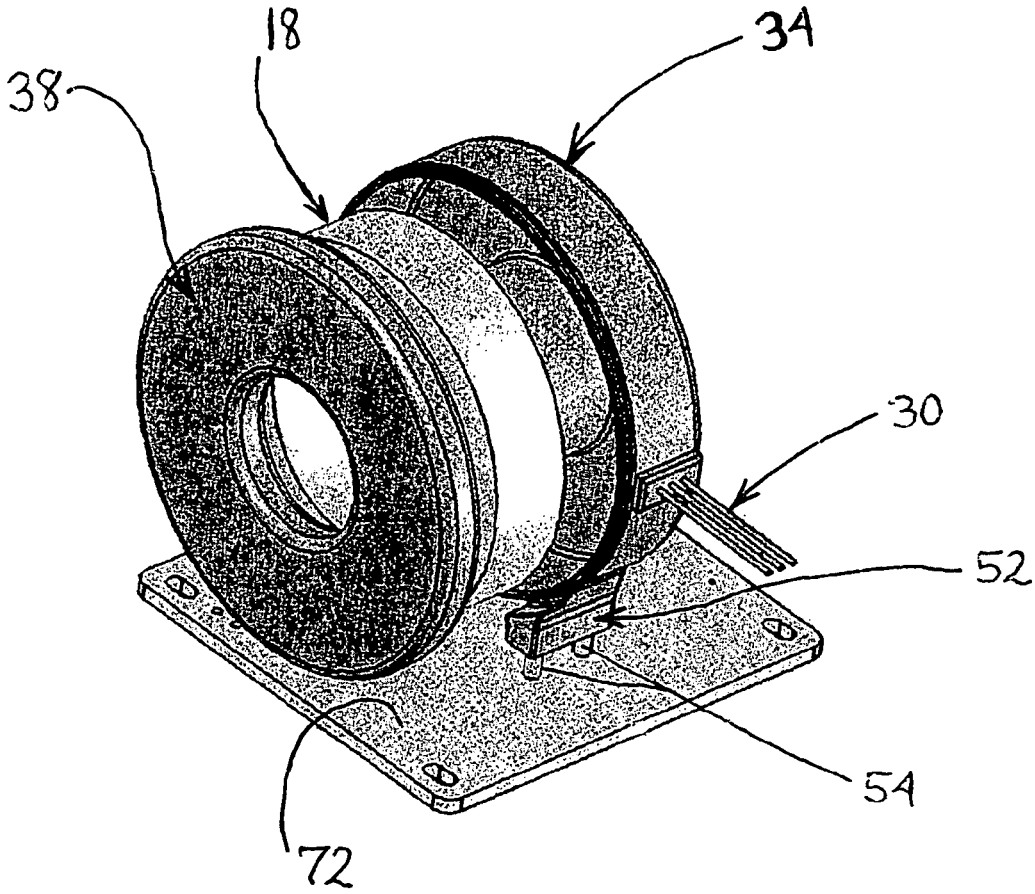
FIG. 2 is a perspective view of a shield case of the transformer wherein a cover and a body of the shield case are spaced apart to show a core/coil assembly which is to be mounted inside the shield case.
Figure 3:
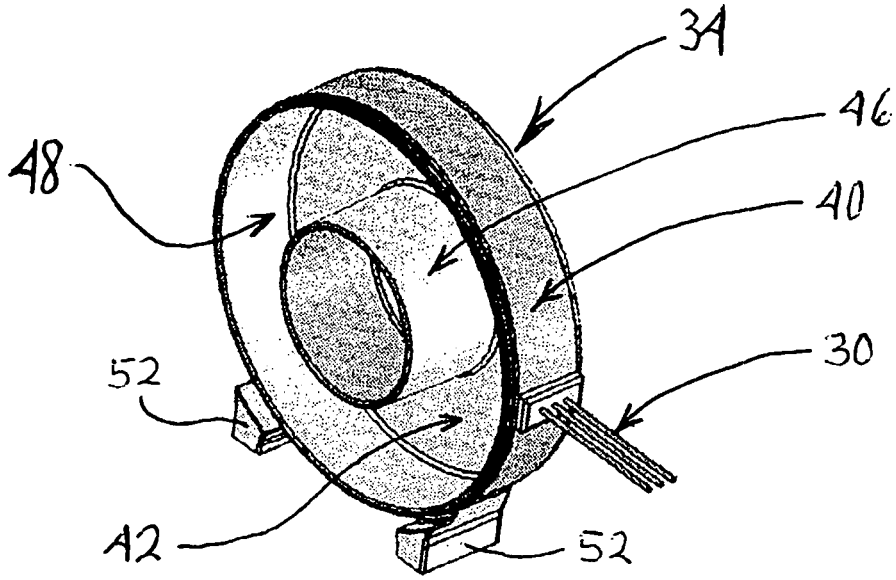
FIG. 3 is a perspective view of the body of the shield case.
Figure 4:
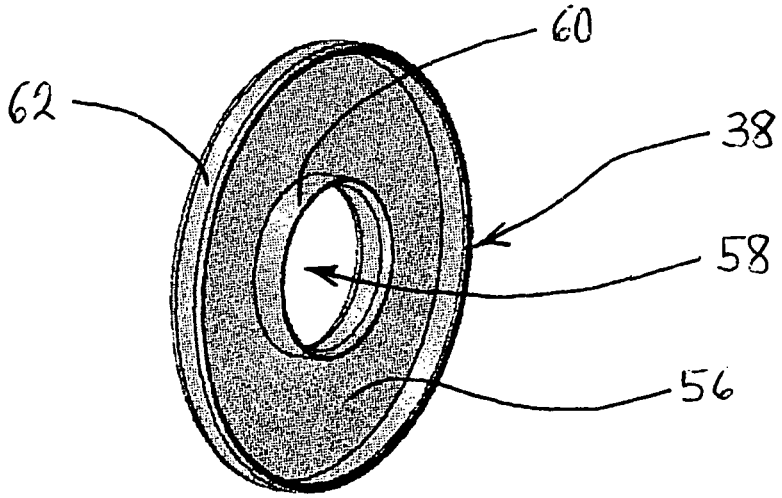
FIG. 4 is a perspective view of an interior side of the cover of the shield case.
Figure 5:
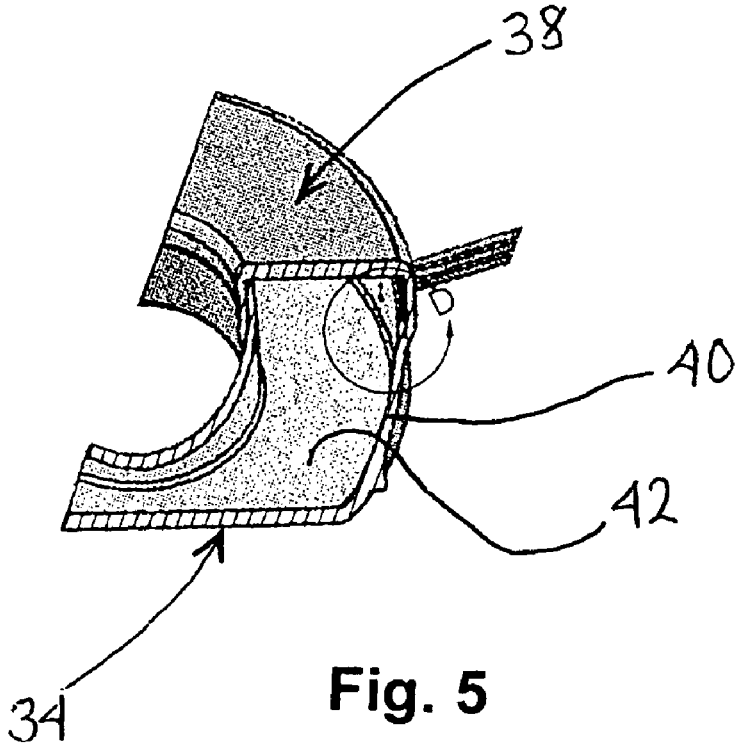
FIG. 5 is a sectional view of a portion of the shield case.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Referring now to FIG. 1, there is shown a schematic view of a transformer 10 constructed in accordance with the present invention. The transformer 10 is a current instrument transformer that is adapted for exterior use. The transformer 10 may step down current in a range of 10 to 2,500 amps to a current in a range of 1 to 5 amps. The transformer 10 generally comprises a core 12, a primary or high voltage winding 14, a secondary or low voltage winding 16, a shield case 22 and an outer housing or encasement 24 formed from a resin 26. The core 12, the high voltage winding 14, the low voltage winding 16 and the shield case 22 are cast into the resin 26 so as to be encapsulated within the encasement 24. As will be described in more detail below, the shield case 22 encloses the core 12 and the low voltage winding 16 and protects them from the resin during the casting process.

The core 12 has a torroidal shape with a central opening and is composed of a ferromagnetic material, such as iron or steel. The core 12 may be comprised of a strip of steel (such as grain-oriented silicon steel), which is wound on a mandrel into a coil. The low voltage winding 16 comprises a length of wire, such as copper wire, wrapped around the core 12 to form a plurality of turns that are disposed around the circumference of the core 12. End portions of the low voltage winding 16 are secured to transformer leads 30 (or form the transformer leads 30), which are connected to a terminal board mounted to the exterior of the outer encasement 24. The combination of the core 12 and the low voltage winding 16 is hereinafter referred to as the core/coil assembly 18. The high voltage winding 14 comprises an open loop of a metallic conductor, which may be comprised of copper. The high voltage winding 14 extends through the shield case 22 and the core/coil assembly 18, as will be described more fully below. A pair of rectangular connectors 32 is secured to the ends of the high voltage winding 14, respectively.

Referring now to FIGS. 2-6, the shield case 22 has a two-piece construction and comprises a body 34 and a cover 38, each of which is formed from a high impact plastic in a reactive injection molding (RIM) process, as will be described more fully below.

The body 34 includes a cylindrical side wall 40 joined to an annular end wall 42 having an enlarged central opening. Openings are formed in the side wall 40 through which the terminal leads 30 extend. A free end of the side wall 40 has an outwardly-facing notch 44 (shown in FIG. 6) formed therein for helping secure the cover 38 to the body 34, as will be described more fully below. A cylindrical mount 46 is joined to the end wall 42, around the central opening, and extends coaxially with the side wall 40. The mount 46, however, extends away from the end wall 42 farther than the side wall 40. The side wall 40, the mount 46 and the end wall 42 cooperate to define an annular groove 48, which is adapted to receive the core/coil assembly 18. A pair of feet 52 is secured to the side wall 40, at the bottom of the body 34. A pair of ground connectors 54 is insert molded into each foot 52 (or otherwise secured to each foot 52) and extend downwardly therefrom. Each ground connector 54 has a threaded bore formed therein.

Figure 6:
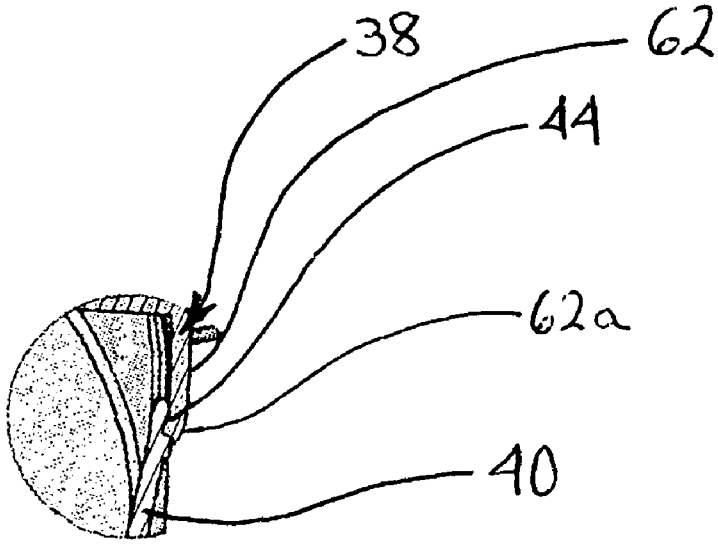
FIG. 6 shows an enlarged view of a portion of the sectional view of the shield case of FIG. 5, wherein the portion is identified by the letter "D" in FIG. 5.

The cover 38 is annular in shape and includes a disc-shaped wall 56 with an opening 58 in the center thereof. An inner flange 60 is disposed around the opening 58 and extends away from the wall 56. An outer flange 62 (shown best in FIG. 6) is disposed around the periphery of the wall 56 and extends away therefrom. A free end 62*a* of the outer flange 62 is bent inwardly slightly and is shaped to fit into the notch 44 of the side wall 40 of the body 34 in an interlocking, snap-fit manner, as is shown in FIG. 6.

The body 34 and the cover 38 are each comprised of a thermoset resin composition and are each formed in a RIM process. The thermoset resin composition comprises a thermoset resin and an amount of conductive particles that is sufficient to render at least the outside surfaces of the body 34 and the cover 38 sufficiently conductive to convey a charge to ground so as to prevent a partial discharge. The thermoset resin may also include various additives to modify the properties of the cured thermoset resin composition. The thermoset resin may be a polynorbornene resin, a polyurethane resin, a polyurea resin, or a polyurethane/polyester resin. Generally, in a RIM process, two reactant compositions are combined in a mixhead, and this mixture is then injected into a mold in which polymerization occurs. For example, if the thermoset resin is a polyurethane resin, a polyisocyanate (e.g., a diisocyanate) will be supplied in one reactant composition and a polyolefin will be supplied in the other reactant composition.

The use of a polynorbornene resin to form the body 34 and the cover 38 is particularly suitable. A polynorbornene resin is formed from one or more norbornene monomers in a ring-opening metathesis polymerization (ROMP) reaction. A norbonene monomer is a bridged cyclic hydrocarbon. Examples of norbornene monomers include 2-norbornene, 5-methyl-2-norbornene, 5-ethyl-2-norbornene, 5-butyl-2-norbornene, 5-hexyl-2-norbornene, 5-ethylidene-2-norbornene, 5-phenylnorbornene, dicyclopentadiene, dihydrodicyclopentadiene, tetracyclododecene, methyl tetracyclododecene, ethyl tetracyclododecene, dimethyl tetracyclododecene, ethylidene tetracyclododecene, phenyl tetracyclododecene, tricyclopentadiene, tetracyclopentadiene and the like. Different combinations of the foregoing monomers may be used.

Dicyclopentadiene (DCPD) and, more specifically, endo-DCPD (3a,4,7,7a-tetrahydro-4,7-methano-1H-indene) is especially suitable for use in forming the body 34 and the cover 38. Commercially available endo-DCPD is initially purified by low vacuum distillation to remove trace impurities. The purified endo-DCPD is then polymerized to form poly-DCPD in a RIM process, using a two-part metathesis catalyst system. The two-part metathesis catalyst system includes a catalyst and a co-catalyst, or activator.

The catalyst may be an organoammonium molybdate, such as tetrakis(trididodecylammonium)octa-molybdate, a tungsten-containing catalyst, such as a tungsten halide (e.g. $WCl_6$) or a tungsten oxyhalide (e.g. $WOCl_4$), or a ruthenium-containing catalyst. Examples of ruthenium-containing catalysts are disclosed in U.S. Pat. Nos. 6,486,270 and 6,204,347, both of which are hereby incorporated by reference. The '270 patent discloses ruthenium alkylidene catalysts that are particularly suitable for use in a RIM process. These ruthenium alkylidene catalysts have the general formula $A_xL_yX_zRu{=}CHR'$, where x=0, 1 or 2, y=0, 1 or 2, and z=1 or 2, and where R' is hydrogen or a substituted or unsubstituted alkyl or aryl, L is any neutral electron donor (such as a phosphine), X is any anionic ligand, and A is a ligand having a covalent structure connecting a neutral electron donor and an anionic ligand. The '347 patent discloses ruthenium catalysts having the formula: $RuX_2(L_1)_m(L_2)_n(L_3)_o(L_4)_p$, or the formula: $ARuX_2(L_1)_r(L_2)_s$, wherein $L_1$, $L_2$, $L_3$ and $L_4$ are each independently of the other C. —$C_1$-$C_{18}$ alkylcyanide, $C_6 \geqq C_{24}$-aralkylcyanide, tertiary amine, tertiary phosphine which does not contain any secondary alkyl or cycloalkyl radicals bound to the phosphorus atom, or phosphite, X is halogen, A is arene, m, n, o and p are integers from 0 to 4, where $2 \leqq m+n+o+p \leqq 4$, r and s are integers from 0 to 2 and where $1 \leqq r+s \leqq 2$.

If an organoammonium molybdate catalyst or a tungsten-containing catalyst is used, the activator may be an alkyl aluminum halide, an alkoxy alkyl aluminum halide, an aryloxy alkyl aluminum halide or an organic tin compound, such as tetrabutyl tin ($SnBu_4$). If a ruthenium alkylidene catalyst of the '270 patent is utilized, the activator is an acid (organic or inorganic), such as hydrochloric acid (HCl), hydrobromic acid (HBr), sulfuric acid ($H_2SO_4$), or nitric acid ($HNO_3$). If a ruthenium catalyst of the '347 patent is utilized, the activator is a tertiary phosphine containing at least one secondary alkyl radical or cycloalkyl radical bound to the phosphorus atom. Examples of such a tertiary phosphine include triisopropylphoshine and tricyclohexylphosphine.

The additives that may be included in the thermoset resin composition include solvents, blowing agents, encapsulated blowing agents, pigments, antioxidants, light stabilizers, flame retardants, plasticizers, foaming agents, fillers, reinforcing agents, macro-molecular modifiers, and polymeric modifiers. Suitable fillers include glass, wollastonite, mica, talc, and calcium carbonate. The additives must be ones that are substantially unreactive with the individual reactant compositions.

The conductive particles in the thermoset resin composition that are used to impart conductivity to the body 34 and the cover 38 may comprise electrically conductive carbon black, carbon nanofibers, graphite, metal particles, or a combination of the foregoing. Metal particles may include, but are not limited to, nickel particles, silver flakes, or particles of tungsten, molybdenum, gold platinum, iron, aluminum, copper, tantalum, zinc, cobalt, chromium, lead, titanium, tin alloys, and mixtures of the foregoing. The conductive particles typically have an average size of less than 30 micrometers, more typically less than 10 micrometers and still more typically less than 5 micrometers. The conductive particles comprise from about 1 weight percent to about 40 weight percent of the total thermoset resin composition, more particularly from about 1 weight percent to about 20 weight percent of the total thermoset resin composition.

Figure 7:
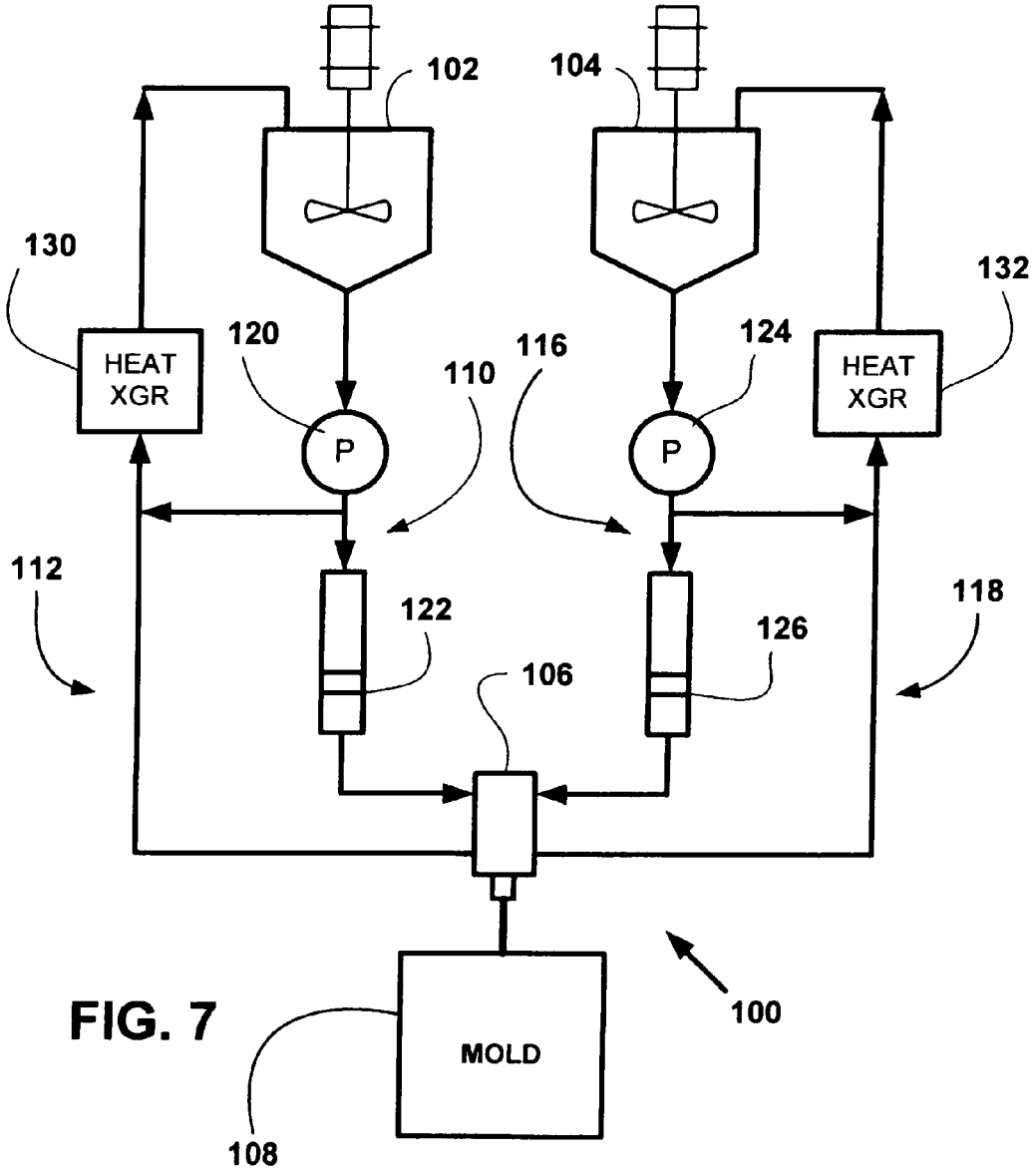
FIG. 7 is a schematic view of a first reactive injection molding system that may be used to form the shield case.

Referring now to FIG. 7, there is shown a schematic drawing of a RIM system 100 that may be used to form the body 34 and the cover 38 from a first reactant composition and a second reactant composition. The RIM system 100 generally includes first and second tanks 102, 104, a mixing head 106, a mold 108 for the body 34 and a mold (not shown) for the cover 38. The first tank 102 is connected to the mixing head 106 by a first supply line 110 and a first return line 112, while the second tank 104 is connected to the mixing head 106 by a second supply line 116 and a second return line 118. When the body 34 is to be molded, the mold 108 is connected to the mixing head 106 to receive the thermoset resin composition therefrom, whereas when the cover 38 is to be molded, the mold for the cover 38 is connected to the mixing head 106 to receive the thermoset resin composition therefrom. A first circulation pump 120 and a first metering pump or piston 122 are connected into the first supply line 110, while a second circulation pump 124 and a second metering pump or piston 126 are connected into the second supply line 116. First and second heat exchangers 130, 132 are connected into the first and second return lines 112, 118, respectively. Valves (not shown) are connected into the first and second supply lines 110, 116 and the first and second return lines 112, 118 to control the flow of material between the first and second tanks 102, 104 and the mixing head 106. The valves and the pumps are connected to and controlled by a control system (not shown).

The first tank 102 contains the first reactant composition, while the second tank 104 comprises the second reactant composition. In the embodiment where the thermoset resin is poly-DCPD, the first reactant composition comprises DCPD monomer, conductive particles and the catalyst, and the second reactant composition comprises DCPD monomer, conductive particles and the co-catalyst. Any additives that are to be included may be divided into about equal parts between the first and second reactant compositions. The amount of the DCPD monomer and the conductive particles in the first and second reactant compositions may be about the same. The first and second reactant compositions are heated and stirred in the first and second tanks 102, 104, respectively. The RIM process begins with the valves to the mixing head 106 opening and the first and second reactant compositions being fed to the mixing head 106 through the first and second supply lines 110, 116, respectively. The first and second metering pistons 122, 126 supply the first and second reactant compositions to the mixing head 106 in metered amounts. The first and second reactant compositions enter a mix chamber in the mixing head 106 and are intensively mixed together by high velocity impingement. The resulting mixture is then injected into the mold 108, where the mixture polymerizes into poly-DCPD and thereby forms the body 34. The mold 108 may be heated to a temperature of from about 50° C. to about 100° C. and the pressure in the mold 108 may be in a range from about 1 to about 10 bars, more particularly from about 1 to about 3 bars. The cover 38 is formed in substantially the same manner, except the mold for the cover 38 is used instead of the mold 108 and the amount of the first and second reactant compositions is different.

When formed in the above-described manner, the conductive particles are substantially evenly distributed throughout the body 34 and the cover 38 so as to provide the body 34 and the cover 38 with sufficient bulk conductivity to convey a charge to ground so as to prevent a partial discharge. In another embodiment of the present invention, a second RIM process may be used to concentrate the conductive particles in the surface regions of the body 34 and the cover 38 so as to provide the body 34 and the cover 38 with only surface conductivity that is sufficient to convey a charge to ground so as to prevent a partial discharge. The ground connectors 54 are electrically connected to the body 34 so as to permit electric current to flow from the body 34 (mass and/or surface) to the ground connectors 54. Since the cover 38 is in intimate contact with the body 34 and is also conductive, the cover 38 is also electrically connected to the ground connectors 54.

Figure 8:
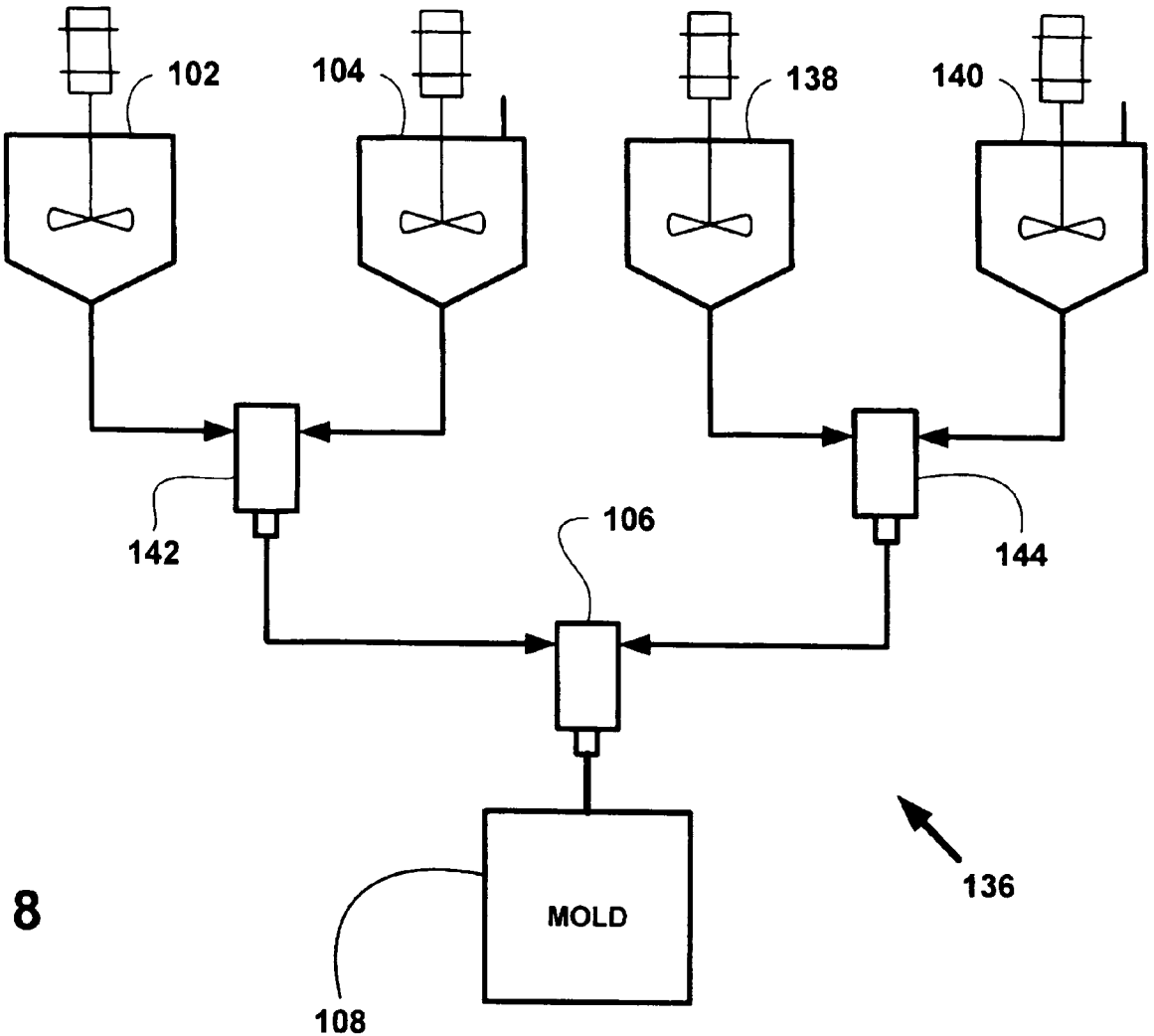
FIG. 8 is a schematic view of a second reactive injection molding system that may be used to form the shield case.

With reference now to FIG. 8, a second RIM system 136 is used to perform the second RIM process. The second RIM system 136 is substantially the same as the RIM system 100, except the second RIM system 136 further includes third and fourth tanks 138, 140 and associated circulation pumps (not shown) and metering pistons (not shown), as well an intermediate first mixer 142 and intermediate second mixer 144. For purposes of better clarity, the circulation pumps, metering pistons, heat exchangers and return lines of the second RIM system 136 are not shown. The first and second tanks 102, 104 are connected to the first mixer 142, while the third and fourth tanks 138, 140 are connected to the second mixer 144. The outputs of the first and second mixers 142, 144, in turn, are connected to the mixing head 106, which is connected to the mold 108 (or the mold for the cover 38). In the second RIM system 136, the thermoset resin composition is formed from first, second, third and fourth reactant components that are stored in the first, second, third and fourth tanks 102, 104, 138,140, respectively. The first and third reactant compositions contain DCPD monomer and the catalyst, while the second and fourth reactant compositions contain DCPD monomer and the co-catalyst. One of the third and fourth reactant compositions contains all of the conductive particles. Any additives that are to be included may be divided into about equal parts between the first, second, third and fourth reactant compositions.

In a first time period of the second RIM process, the third and fourth reactant compositions alone, or in combination with a lesser or equal amount of the first and second reactant compositions, are injected into the mold 108. In a subsequent second time period, only the first and second reactant compositions are injected into the mold 108. In this manner, the conductive particles are concentrated in the surface region of the formed body 34 (or cover 38).

After the body 34 and the cover 38 are molded as described above, the core/coil assembly 18 is disposed in the groove 48 of the body 34 so that the core/coil assembly 18 abuts the end wall 42 and the mount 46 extends through the central opening of the core/coil assembly 18. While the core/coil assembly 18 is so positioned, the cover 38 is placed over the body 34 such that the mount 46 is disposed inside the cover 38, against the inner flange 60, and the free end 62*a* of the outer flange 62 is snapped into the outer notch 44 of the side wall 40 of the body 34. In this manner, the cover 38 is secured to the body 34 in a snap-fit manner so as to enclose the core/coil assembly 18 in the shield case 22 and thereby seal the core/coil assembly 18 from the resin 26 when the shield case 22 with the core/coil assembly 18 is cast into the resin 26 to form the outer encasement 24, as will be described below.

The resin 26 may be butyl rubber or an epoxy cast resin. In one embodiment of the present invention, the resin 26 is a cycloaliphatic epoxy resin, more particularly a hydrophobic cycloaliphatic epoxy resin. In this embodiment, the outer casement 24 is formed from the resin 26 in an automatic pressure gelation (APG) process. In accordance with APG process, the resin 26 (in liquid form) is degassed and preheated to about 40° C. to about 60° C., while under vacuum. The shield case 22 with the core/coil assembly 18 disposed therein is placed in a cavity of a mold heated to a curing temperature of the resin 26. The transformer leads 30, the connectors 32 and the ground connectors 54 extend out of the cavity so as to protrude from the encasement 24 after the casting process. The degassed and preheated resin 26 is then introduced under slight pressure into the cavity containing the shield case 22. Inside the cavity, the resin 26 quickly starts to gel. The resin 26 in the cavity, however, remains in contact with pressurized resin 26 being introduced from outside the cavity. In this manner, the shrinkage of the gelled resin 26 in the cavity is compensated for by subsequent further addition of degassed and preheated resin 26 entering the cavity under pressure. As the resin 26 gels and fully cures, the resin 26 shrinks and applies forces against the shield case 22. The shield case 22 protects the core/coil assembly 18 from these forces, thereby preventing the oriented grains of the core 12 from becoming distorted.

It should be appreciated that in lieu of being formed pursuant to an APG process, the encasement 24 may be formed using a compression molding process or a vacuum casting process.

After the resin 26 cures, the solid encasement 24 with the shield case 22 molded therein is removed from the mold cavity. The solid encasement 24 includes a top portion 24*a* with a plurality of annular fins or skirts 70 formed therein and a bottom portion 24*b* with a flat end wall. The connectors 32 for the high voltage winding 14 protrude upwardly from the top portion 24*a*, while the transformer leads 30 protrude laterally from the bottom portion 24*b*. A housing (not shown) containing a terminal board is secured to the bottom portion 24*a* of the encasement 24. The transformer leads 30 are disposed in the housing and are connected to the terminal board. The ground connectors 54 extend through the end wall of the bottom portion 24*a* such that end surfaces of the ground connectors 54 are substantially flush with the end wall. A base plate 72 composed of a conductive metal, such as aluminum, is secured to the end wall of the bottom portion 24*a* by screws or other fastening means. Openings in the base plate 72 are aligned with the bores in the ground connectors 54. Screws composed of a conductive metal are inserted through the openings in the base plate 72 and are threadably received in the bores in the ground connectors 54. Heads of the screws abut an exterior surface of the base plate 72. Thus, the screws form electrical connections between the base plate 72 and the ground connectors 54. When the transformer 10 is installed for use, the base plate 72 is electrically connected to an earth ground. Since the base plate 72 is electrically connected to the ground connectors 54, which are electrically connected to the shield case 22, the shield case 22 becomes grounded as well. In this manner, the shield case 22 forms a Faraday shield around the core/coil assembly 18. This Faraday shield will help reduce, if not eliminate, partial discharges that can damage the encasement 24.

Figure 9:
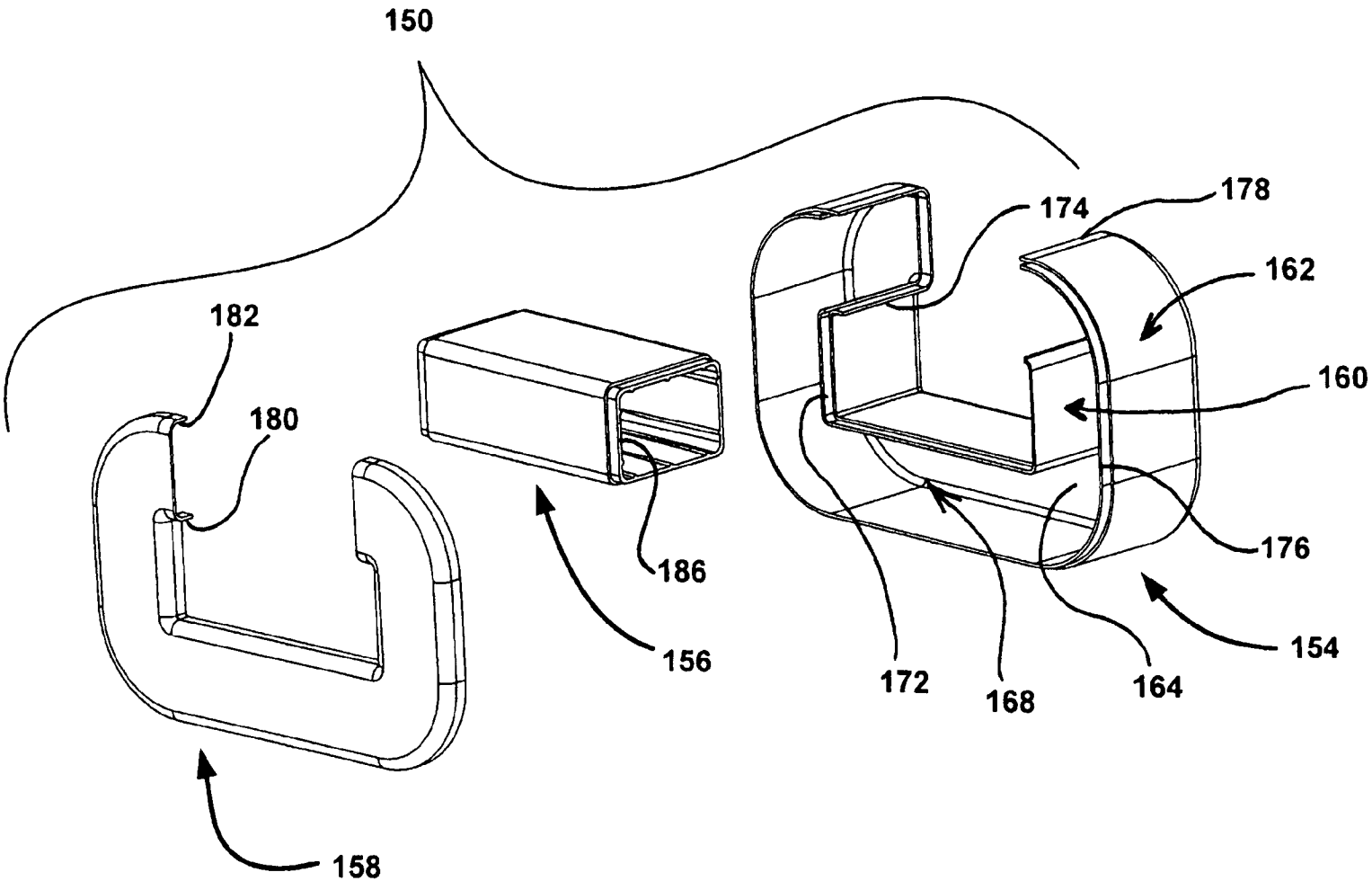
FIG. 9 is an exploded view of a second shield case of a second transformer.
Figure 10:
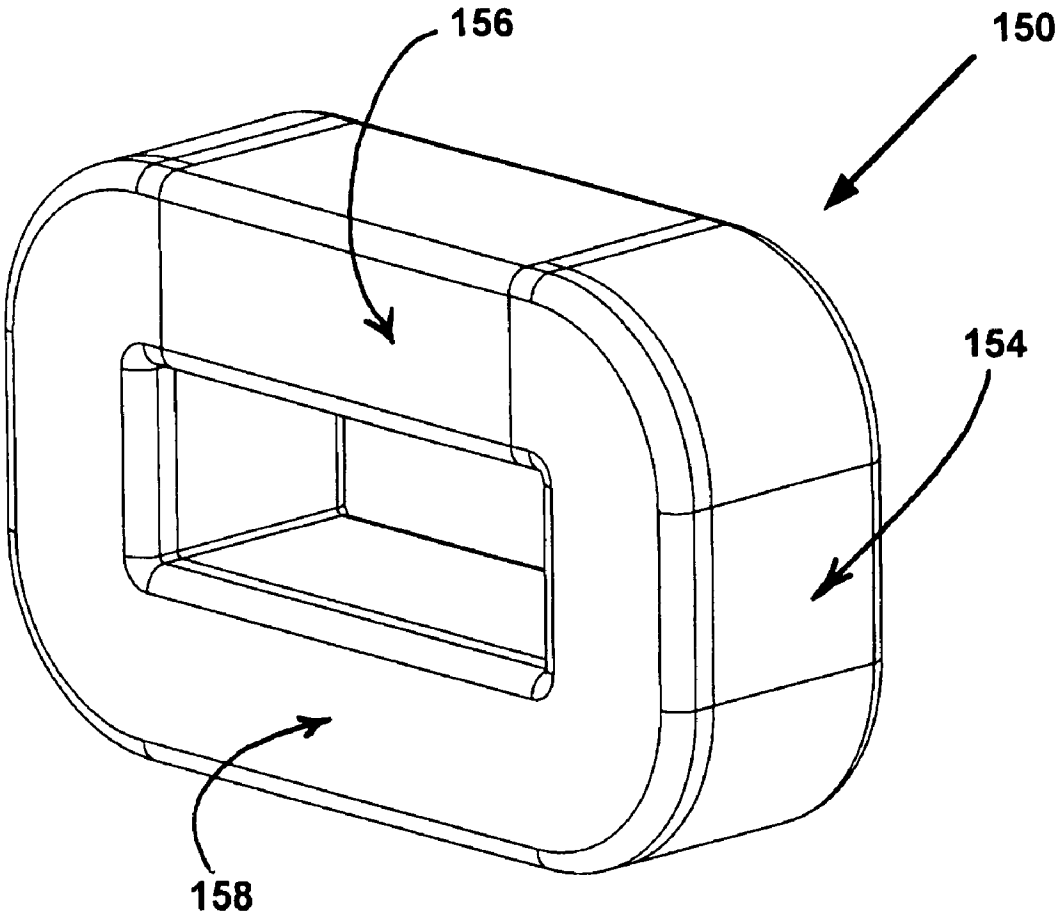
FIG. 10 is a perspective view of the second shield case in an assembled state.
Figure 11:
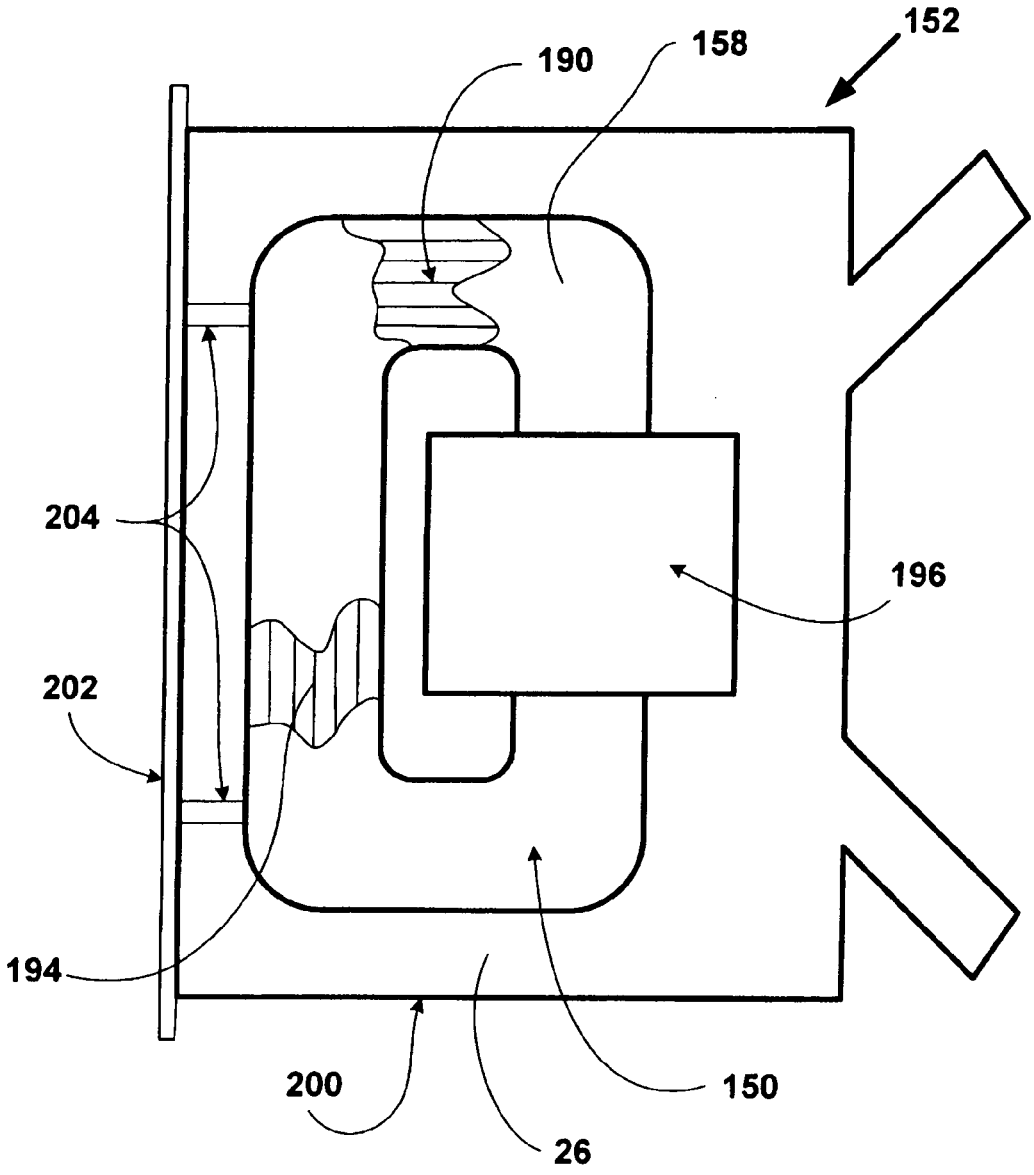
FIG. 11 is a schematic view of the second transformer with the second shield case mounted inside.

In the embodiment of the invention described above, the shield case 22 encloses both the core 12 and the low voltage winding 16, i.e., the core/coil assembly 18. In other embodiments of the present invention, a shield case may enclose only a core or only a portion of core. In addition, shield cases of different configurations may be provided for different types of transformers. An example of another embodiment of the invention is shown in FIGS. 9 and 10 and comprises a shield case 150. The shield case 150 is constructed to be used in a voltage instrument transformer 152, which is shown in FIG. 11.

Referring now to FIGS. 9 and 10, the shield case 150 includes a C-shaped major body 154, a conduit-shaped minor body 156 and a C-shaped cover 158. The major body 154 includes a C-shaped inner wall 160 and a C-shaped outer wall 162 that extend perpendicularly outward from a C-shaped bottom wall 164. The inner wall 160, the outer wall 162 and the bottom wall 164 cooperate to define an open C-shaped groove 168, which is adapted to receive a portion of a core 190 of the transformer 152. The minor body 156 has an enclosed periphery and a rectangular cross section. The cover 158 and the major body 154 are constructed such that the cover 158 may be disposed over and releasably engaged with the major body 154 so as to cover the groove 168. The cover 158, the major body 154 and the minor body 156 are constructed such that the minor body 156 may extend between and releasably engage opposing ends of the combined major body 154/cover 158.

The inner wall 160 of the major body 154 has an outwardly-positioned flange 172, while the outer wall 162 of the major body 154 has an inwardly-positioned flange 176. The cover 158 has an inner flange 180 and an outer flange 182. Opposing ends of the inner wall 160 each have an inwardly-positioned flange 174, while opposing ends of the outer wall 162 each have an outwardly-positioned flange 178. The cover 158 is configured such that when the cover 158 is disposed over and placed into engagement with the major body 154, the inner and outer flanges 180, 182 of the cover 158 frictionally engage the flanges 172, 176 of the major body 154, respectively, with the flange 172 being disposed outward from the inner flange 180 and the flange 176 being disposed inward from the outer flange 182.

The minor body 156 has opposing ends, each of which has an inwardly-positioned peripheral flange 186. When the minor body 156 is disposed between and placed into engagement with the ends of the major body 154 and the cover 158, the flanges 174, 178, 180, 182 of the major body 154 and the cover 158 and the flanges 186 of the minor body 156 frictionally engage each other and overlap, with the flanges 174, 178, 180, 182 of the major body 154 and the cover 158 being disposed outward from the flanges 186 of the minor body 156.

The components of the shield case 150 (i.e., the major body 154, the minor body 156 and the cover 158) are each comprised of a conductive thermoset resin composition and are each formed in a RIM process. The thermoset resin composition used to form the shield case 150 may have the same composition as the thermoset resin composition used to form the components of the shield case 22 (i.e., the body 34 and the cover 38). In addition, the components of the shield case 150 may be formed using the RIM process of the RIM system 100, or the second RIM process of the second RIM system 136, which were described above. With the shield case 150 being comprised of a conductive polymer as described above, the shield case 150 has sufficient bulk conductivity and/or surface conductivity to convey a charge to ground so as to prevent a partial discharge.

Referring now to FIG. 11, a schematic view of the voltage transformer 152 is shown. Portions of the cover 158 of the shield case 150 are broken away to show the core 190, which is formed from one or more strips of ferromagnetic material, such as silicone steel, that is/are wound into a generally rectangular body with a central opening and a pair of legs 194. During the formation of the transformer 152, a portion of the core 190 is capable of being moved so as to open the core 190 and permit a coil 196 assembly wound over the minor body 156 to be mounted to one of the legs 194. The coil assembly 196 comprises a primary winding and a secondary winding and may be wound over the minor body 156 in a winding machine. After the coil assembly 196 and the minor body 156 are mounted to the core 190, the movable portion of the core 190 is secured to the remaining portion of the core 190 to prevent the core 190 from being opened. The exposed C-shaped portion of the core 190 is then placed into the groove 168 of the major body 154 and the flanges 186 of the minor body 156 are engaged with the flanges 174, 178 of the major body 154. The cover 158 is then secured to the major body 154 so as to cover the groove 168 and, thus, the C-shaped portion of the core 190. At this point, the entire core 190 is enclosed within the shield case 150. This assembly is then cast into the resin 26 to form an outer encasement 200. Once again, the resin 26 may be butyl rubber or an epoxy cast resin, such as a hydrophobic cycloaliphatic epoxy resin. A base plate 202 composed of a conductive metal, such as aluminum, is secured to an end wall of the encasement 200 by screws or other fastening means. Ground connectors 204 electrically connect the shield case 150 to the base plate 202. When the transformer 152 is installed for use, the base plate 202 is electrically connected to an earth ground. Since the base plate 202 is electrically connected to the shield case 150, the shield case 150 becomes grounded as well. In this manner, the shield case 150 forms a Faraday shield around the core 190 and the coil 196. This Faraday shield will help reduce, if not eliminate, partial discharges that can damage the encasement 200.

Figure 12:
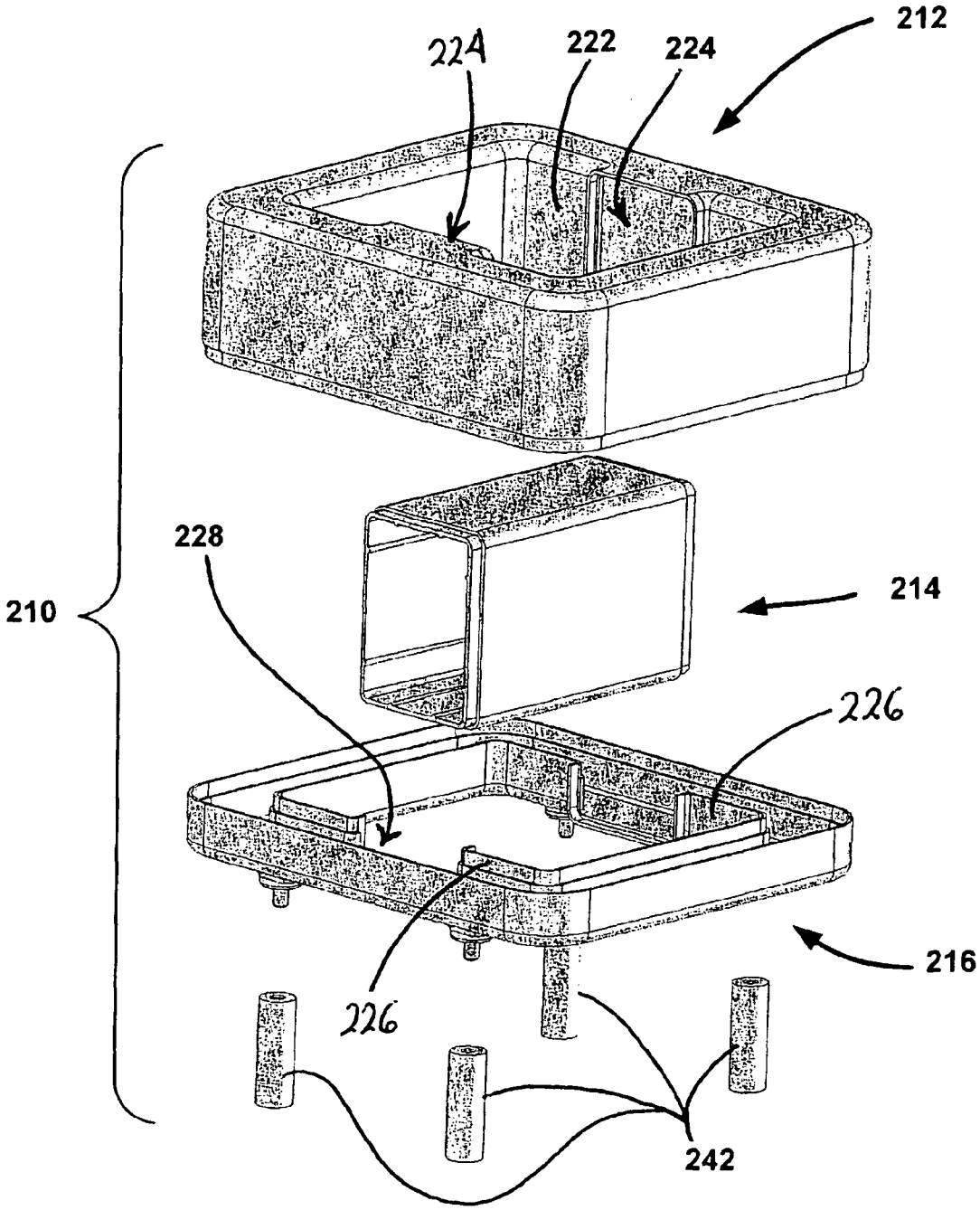
FIG. 12 is an exploded view of a third shield case of a third transformer.

Referring now to FIG. 12, there is shown a shield case 210 constructed in accordance with another embodiment of the present invention. The shield case 210 is constructed to be used in a voltage instrument transformer 208, which is shown in FIG. 13.

The shield case 210 comprises a rectangular major body 212, a conduit-shaped minor body 214 and a rectangular cover 216. The major body 212 includes a pair of opposing inner side walls 222, each having a flanged opening 224. The cover 216 has a pair of opposing inner flanges or skirts 226 that correspond to the inner side walls 222 of the major body 212. Each of the skirts 226 has a flanged opening 228. The major body 212 defines a rectangular groove (not shown), which is adapted to receive portions of first and second cores 218, 220 of the transformer 208. The minor body 214 has an enclosed periphery and a rectangular cross section. The cover 216 and the major body 212 are constructed such that the cover 216 may be disposed over and releasably engaged with the major body 212 so as to cover the groove. When the cover 216 is engaged with the major body 212, the flanged openings 224 of the major body 212 cooperate with the flanged openings 228 of the cover 216 to form flanged composite openings. The minor body 214 extends between the side walls 222 and the side skirts 226 and has opposing flanged ends that engage the flanged composite openings of the combined major body 212/cover 216.

The components of the shield case 210 (i.e., the major body 212, the minor body 214 and the cover 216) are each comprised of a conductive thermoset resin composition and are each formed in a RIM process. The thermoset resin composition used to form the shield case 210 may have the same composition as the thermoset resin composition used to form the components of the shield case 22 (i.e., the body 34 and the cover 38). In addition, the components of the shield case 210 may be formed using the RIM process of the RIM system 100, or the second RIM process of the second RIM system 136, which were described above. With the shield case 210 being comprised of a conductive polymer as described above, the shield case 210 has sufficient bulk conductivity and/or surface conductivity to convey a charge to ground so as to prevent a partial discharge.

Figure 13:
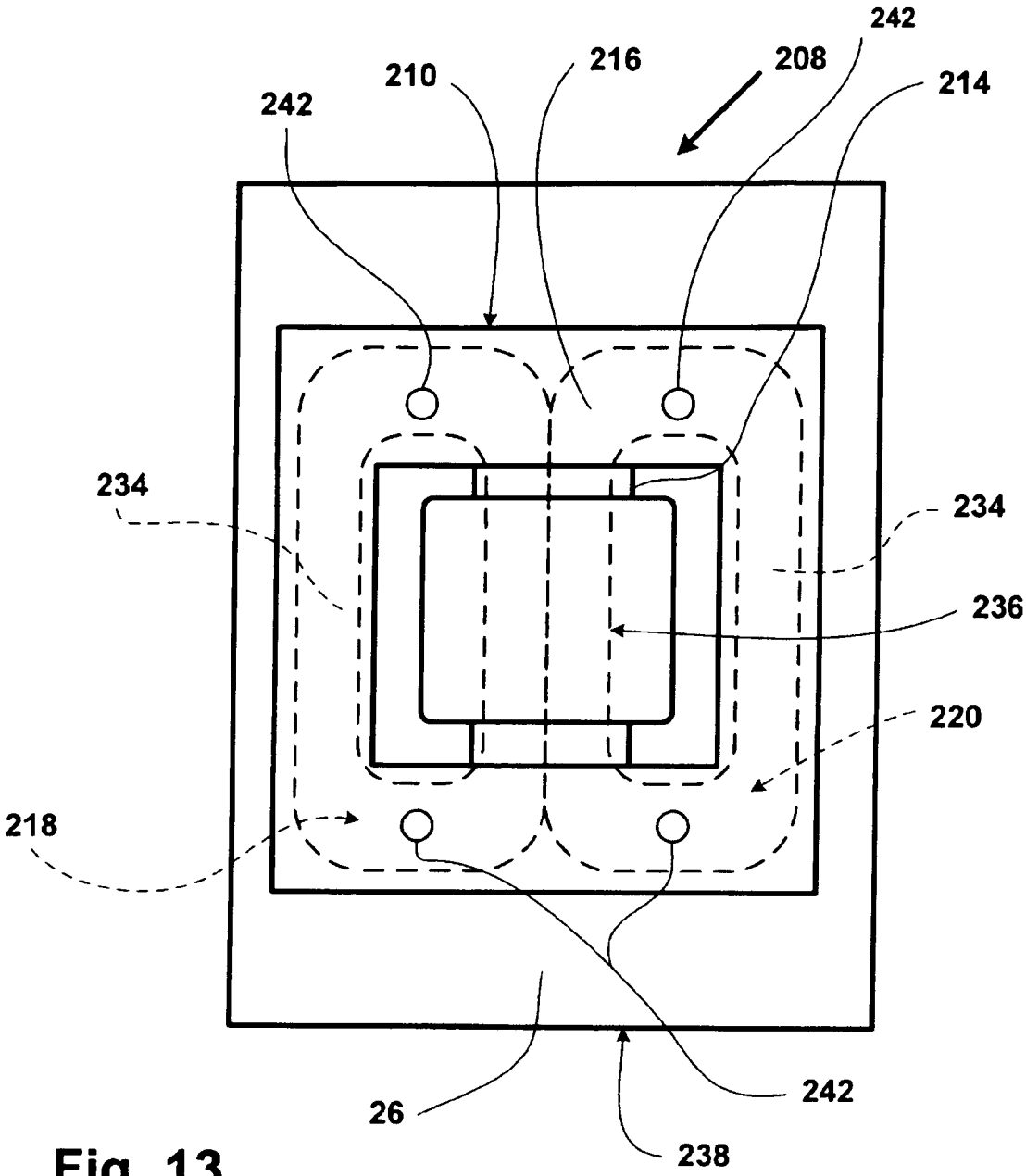
FIG. 13 is a schematic view of the third transformer with the third shield case mounted inside.

Referring now to FIG. 13, the voltage transformer 208 has a dual core construction and includes a first core 218 (shown in phantom) and a second core 220 (shown in phantom), each of which is formed from one or more strips of ferromagnetic material, such as silicone steel, that is/are wound into a generally rectangular body with a central opening and a pair of legs 234 (shown in phantom). The first and second cores 218, 220 are disposed side-by-side to each other, with a leg 234 of the first core 218 adjoining a leg 234 of the second core 220. During the formation of the transformer 208, a portion of each of the first and second cores 218, 220 is capable of being moved so as to open the first and second cores 218, 220 and permit a coil assembly 236 wound over the minor body 214 to be mounted to the adjoining legs 234. The coil assembly 236 includes a primary winding and a secondary winding and may be wound over the minor body 214 in a winding machine. After the coil assembly 236 and the minor body 214 are mounted to the first and second cores 218, 220, the movable portions of the first and second cores 218, 220 are secured to the remaining portions of the first and second cores 218, 220 to prevent the first and second cores 218, 220 from being opened. The exposed portions of the first and second cores 218, 220 are then placed into the rectangular groove of the major body 212 and the cover 216 is then fastened to the major body 212. At this point, both of the first and second cores 218, 220 are fully enclosed within the shield case 210. This assembly is then cast into the resin 26 to form an outer encasement 238. Once again, the resin 26 may be butyl rubber or an epoxy cast resin, such as a hydrophobic cycloaliphatic epoxy resin. A base plate (not shown) composed of a conductive metal, such as aluminum, is secured to an end wall of the encasement 238 by screws or other fastening means. Ground connectors 242 electrically connect the shield case 210 to the base plate 240. The ground connectors 242 may be composed of metal, or may, alternately, be composed of the same conductive thermoset resin composition as the shield case 210. Indeed the ground conductors 242 may be integrally molded with the cover 216. When the transformer 208 is installed for use, the base plate is electrically connected to an earth ground. Since the base plate is electrically connected to the shield case 210, the shield case 210 becomes grounded as well. In this manner, the shield case 210 forms a Faraday shield around the first and second cores 218, 220 and the coil 236. This Faraday shield will help reduce, if not eliminate, partial discharges that can damage the encasement 238.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A transformer comprising:

a shield case formed from a polymeric resin composition comprising conductive particles;

a toroidal core comprised of ferromagnetic material and having a center opening;

a secondary winding wound around a circumference of the core, wherein the core and the secondary winding are disposed in the shield case;

a primary winding extending through the center opening of the toroidal core; and an encasement encapsulating the shield case, the encasement comprising a dielectric resin.

2. The transformer of claim 1, wherein the dielectric resin comprises an epoxy resin.

3. The transformer of claim 2, wherein the dielectric resin comprises a hydrophobic cycloaliphatic epoxy resin.

4. The transformer of claim 1, wherein the shield case comprises a cover releasably secured to a body.

5. The transformer of claim 4, wherein the body and the cover are each formed by reactive injection molding.

6. The transformer of claim 5, wherein the polymeric resin composition further comprises a thermoset resin selected from the group consisting of a polynorbornene resin, a polyurethane resin, a polyurea resin and a polyurethane/polyester resin.

7. The transformer of claim 6, wherein the thermoset resin is a polynorbornene resin.

8. The transformer of claim 7, wherein the thermoset resin is poly(dicyclopentadiene).

9. The transformer of claim 1, further comprising an electrical conductor electrically connected to the shield case and accessible from the exterior of the encasement.

10. The transformer of claim 9, wherein the electrical conductor comprises a metallic plate secured to the encasement, the metallic plate being connected to earth ground, thereby grounding the shield case and forming a faraday shield around at least a portion of the core.

11. A transformer comprising;

a shield case formed from a polymeric resin composition comprising conductive particles;

a core comprised of ferromagnetic material, at least a portion of the core being disposed inside the shield case;

a primary coil and a secondary coil disposed proximate to the core;

an encasement encapsulating the shield case, the encasement comprising a dielectric resin; and wherein the core has a rectangular shape and comprises a pair of legs, and wherein the shield case comprises a major body, a minor body and a cover releasably secured to the major body, the minor body being disposed around one of the legs of the core.

12. The transformer of claim 11, wherein the primary and secondary coils wound around the minor body.

13. The transformer of claim 12, wherein the major body and the cover are each C-shaped.

14. The transformer of claim 12, wherein the core is a first core and wherein the transformer further comprises a second core with a rectangular shape and a pair of legs, wherein the minor body is disposed around one of the legs of the first core and around one of the legs of the second core, and wherein the major body and the cover each have a rectangular shape.

15. A method of producing a transformer comprising:

providing a shield case formed from a polymeric resin composition containing conductive particles;

providing a core comprised of ferromagnetic material;

providing a coil;

disposing the coil around the core;

placing at least a portion of the core inside at least a portion of the shield case; and encapsulating the shield case in a dielectric resin; and wherein the shield case comprises a major body, a minor body and a cover, and wherein the step of providing the coil comprises wrapping a length of conductor around the minor body to form the coil, and wherein the steps of disposing the coil around the core and placing at least a portion of the core inside at least a portion of the shield case comprises disposing the minor body with the coil wound thereon around a leg of the core.

16. The method of claim 15, wherein the step of providing the shield case comprises reaction injection molding the shield case from the polymeric resin composition, which further comprises dicyclopentadiene and a catalyst system.

17. The method of claim 15, wherein the step of placing at least a portion of the core inside at least a portion of the shield case comprises placing the entire core inside the shield case.

* * * * *